US009714071B2

(12) United States Patent
McDonald et al.

(10) Patent No.: US 9,714,071 B2
(45) Date of Patent: Jul. 25, 2017

(54) BREAKAWAY SHAFT

(71) Applicant: Caterpillar Inc., Peoria, IL (US)

(72) Inventors: Patrick J. McDonald, Simpsonville, SC (US); John Schlintz, Milwaukee, WI (US); Bryan Danner, Oshkosh, WI (US)

(73) Assignee: Caterpillar Inc., Peoria, IL (US)

( * ) Notice: Subject to any disclaimer, the term of this patent is extended or adjusted under 35 U.S.C. 154(b) by 342 days.

(21) Appl. No.: 14/334,259

(22) Filed: Jul. 17, 2014

(65) Prior Publication Data

US 2016/0016645 A1 Jan. 21, 2016

(51) Int. Cl.

| | |
|---|---|
| ***B63B 43/18*** | (2006.01) |
| ***B63H 5/16*** | (2006.01) |
| ***B63H 5/125*** | (2006.01) |

(52) U.S. Cl.

CPC ..... *B63B 43/18* (2013.01); *B63H 5/165* (2013.01); *B63H 5/125* (2013.01)

(58) Field of Classification Search

CPC ..... B63H 5/125; B63H 5/1252; B63H 5/165; B63H 2005/1254; B63H 2005/1256; B63B 43/18; F16B 17/00; F16B 19/002; F16B 19/00; F16B 19/02; F16B 21/12; F16B 41/002; F16B 21/00; F16B 13/00; F16B 5/0088; F16B 12/36; F16B 12/24

USPC ..... 411/452; 403/280

See application file for complete search history.

(56) References Cited

U.S. PATENT DOCUMENTS

| | | | | | |
|---|---|---|---|---|---|
| 1,824,213 | A | | 9/1931 | Johnson | |
| 1,931,075 | A | | 10/1933 | Johnson | |
| 1,943,288 | A | | 1/1934 | Chandler et al. | |
| 2,219,197 | A | * | 10/1940 | Purtell | F16B 19/02 403/280 |
| 2,223,871 | A | * | 12/1940 | Johnson | F16B 19/02 411/453 |
| 2,681,029 | A | * | 6/1954 | Canazzi | B63H 5/125 123/41.31 |
| 2,917,019 | A | * | 12/1959 | Krueger | B63B 43/18 114/65 R |
| 3,238,914 | A | | 3/1966 | Swallow | |
| 4,041,792 | A | * | 8/1977 | Miller | B62D 55/125 74/405 |
| 4,266,737 | A | * | 5/1981 | Mastriani | B65H 18/106 242/530.3 |
| 4,638,608 | A | | 1/1987 | Coy | |
| 4,728,308 | A | * | 3/1988 | Weismann | B63H 5/1252 440/57 |
| 4,869,121 | A | * | 9/1989 | Meisenburg | B63H 21/28 74/323 |
| 5,018,953 | A | * | 5/1991 | Matsubara | F04C 29/0078 403/318 |

(Continued)

*Primary Examiner* — Nathaniel Wiehe
*Assistant Examiner* — Eric Zamora Alvarez
(74) *Attorney, Agent, or Firm* — Miller, Matthias & Hull

(57) ABSTRACT

A drive pod of a watercraft such as a boat may be designed to break off the hull of the boat in the event of an underwater collision involving the drive pod. A shaft assembly that transmits power from the engine in the hull to blades or a jet in the drive pod is designed to break at a precise point so that seals in the hull and seals in the drive pod are protected from damage. The shaft assembly may include an axial blind hole with an undercut at a bottom of the blind hole. A pin may be inserted to reinforce the shaft above the undercut.

14 Claims, 6 Drawing Sheets

(56) References Cited

U.S. PATENT DOCUMENTS

| | | | | |
|---|---|---|---|---|
| 5,573,372 | A | 11/1996 | Badger | |
| 6,315,623 | B1 | 11/2001 | Hedlund | |
| 7,435,147 | B1 | 10/2008 | Eichinger | |
| 7,588,473 | B2 * | 9/2009 | Beachy Head | B63H 5/1252 440/53 |
| 7,597,517 | B2 * | 10/2009 | Beeles | F16B 19/05 29/243.529 |
| 7,867,046 | B1 | 1/2011 | Eichinger | |
| 8,011,983 | B1 | 9/2011 | Davis et al. | |
| 8,062,082 | B1 | 11/2011 | Anderson et al. | |
| 8,556,761 | B1 * | 10/2013 | Carlton | F16H 57/0486 475/159 |
| 8,579,669 | B2 | 11/2013 | Sjoblom et al. | |
| 2011/0056329 | A1 | 3/2011 | Sjoeblom et al. | |

* cited by examiner

BREAKAWAY SHAFT

TECHNICAL FIELD

The present disclosure relates generally a marine powertrain and more specifically to a breakaway shaft for a drive pod used in a watercraft.

BACKGROUND

Drive pods are becoming more common in marine applications, such as pleasure boats and other recreational watercraft. The drive pods offer better efficiency and lower noise compared to a traditional shaft and propeller drive system. To protect the integrity of the hull, drive pods are designed to separate from a boat hull if an underwater obstruction is encountered. Care must be taken in designing the drive pod so that the hull remains watertight after an impact that causes the drive pod to detach.

For example, U.S. Pat. No. 8,011,983 (the '983 patent) describes a breakaway mount in which an upper drive shaft and a lower drive shafts are connected via a coupler that allows the lower drive shaft and/or coupler to drop off when the drive pod detaches. However, shear forces applied to the drive pod may cause either the upper or lower drive shafts to fail at a point away from the coupler resulting in one or more of several undesirable outcomes. One undesirable outcome is damage to seals necessary for hull integrity and may pose a threat of sinking the boat. Another undesirable outcome is damage to seals in the drive pod that may allow the drive pod to leak oil into the environment, take on seawater which may further damage the drive pod, or both. The '983 patent fails to disclose a lower drive shaft assembly that consistently channels impact forces to a single point of failure.

SUMMARY

In one aspect, a drive pod for use in a marine craft propulsion system may include a housing configured for through-hull coupling to an engine, a gearbox, and a shaft coupled between the gearbox and the engine. The shaft may include a spline portion disposed at a first end of the shaft, a shank portion at a second end of the shaft distal to the first end, and a connecting portion adjacent to the spline portion. A blind hole may be disposed axially in the first end that extends through the spline portion. The blind hole may also include a thinned portion axially aligned at a lower extent of the blind hole, the thinned portion having an axially symmetric cross-sectional area that is smaller than a cross-sectional area of the spline portion. The shaft may also include a gear portion located between the spline portion and the shank portion. The shaft assembly may also include a pin disposed in the blind hole to a second depth from the first end, the second depth less than the first depth.

In another aspect, a method of making a shaft assembly for use in a drive pod of a marine craft propulsion system includes providing a shaft having a first end and second end opposite the first end, with a shank portion adjacent to the second end. The method may include forming a spline portion adjacent to the first end of the shaft, forming a connecting portion adjacent to the spline portion, and forming a gear portion between the connecting portion and the shank portion. The method may further include forming a blind hole axially in the first end of the shaft and forming a thinned portion axially aligned with a bottom of the blind hole, the thinned portion having an axially symmetric cross-sectional area that is smaller than a cross-sectional area of the spline portion. The method may also include disposing a pin in the blind hole between the first end and the undercut.

In yet another aspect of the disclosure a shaft assembly for use in a drive pod of a marine craft may include a shaft with a spline portion disposed at a first end of the shaft, a connecting portion adjacent to the spline portion, and a blind hole disposed axially in the first end. The blind hole may extend through the spline portion and have an undercut at a lower extent of blind hole. The shaft of the shaft assembly may also include a gear portion and a shank portion arranged between the connecting portion and a second end of the shaft distal to the first end, the shank portion configured for mating with a bearing in the drive pod. The shaft assembly may also include a pin disposed in the blind hole of the shaft. When the shaft assembly is used in the drive pod and subjected to a shear force, the shaft assembly may break apart at the undercut.

These and other benefits will become apparent from the specification, the drawings and the claims.

DESCRIPTION

A shaft for use in a drive pod has a blind hole with an undercut that creates reliable point of failure for the shaft when a drive pod is separated from the hull of a watercraft. This point of failure allows the forces associated with encountering an obstruction to break the shaft with a repeatable shape and location, while providing the structural integrity required to transmit a maximum torque load to the drive screws in the drive pod.

Figure 1:
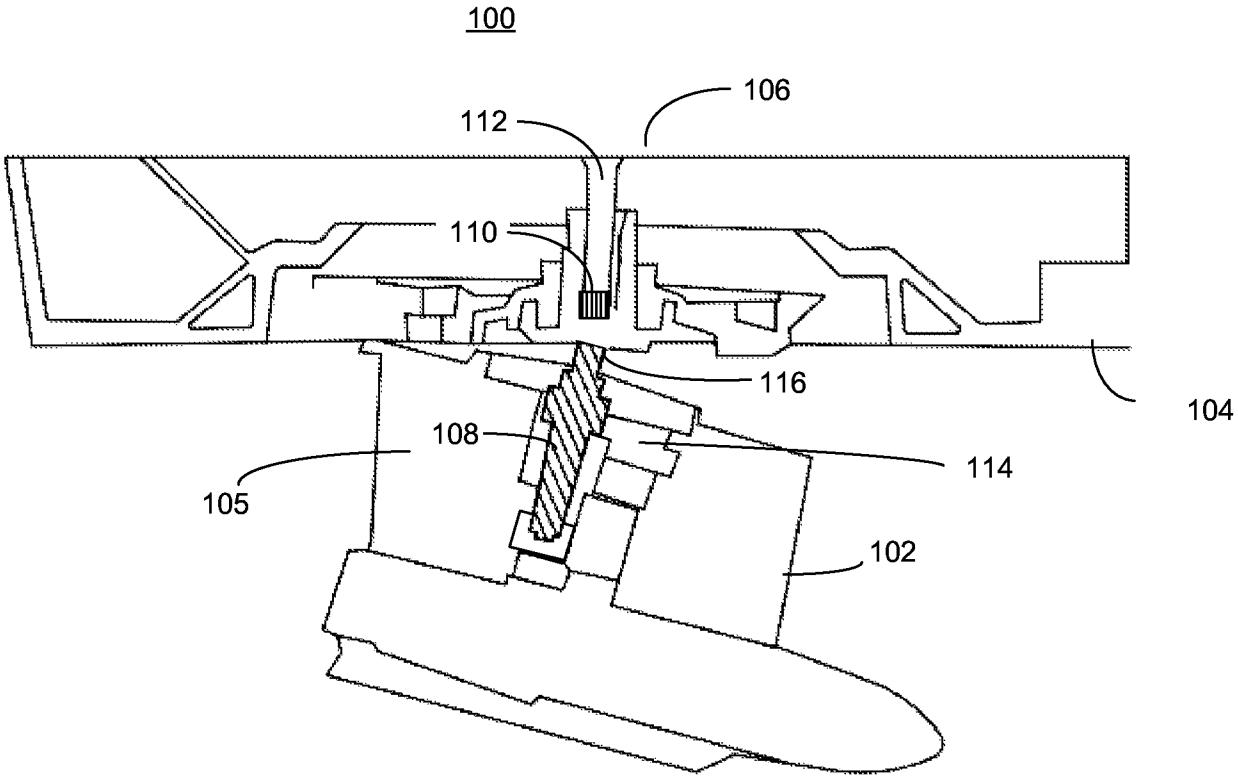
FIG. 1 is a view of a portion of a boat hull and drive pod during a separation event.

FIG. 1 illustrates a cutaway view of a portion of a boat 100 or other marine craft during a separation event. The boat 100 may include a drive pod 102 with a housing 105 normally attached to a hull 104 of the boat 100 at an engine 106. A shaft assembly 108, that in normal use includes a spline portion 110, is coupled between a drive shaft 112 of the engine 106 and a gear box 114 of the drive pod 102. The drive pod 102 may be rotatably attached to the hull 104 and/or engine 106 so that the drive pod 102 provides both propulsion and steering for maneuvering the boat 100.

Upon striking an obstruction, the drive pod 102 may break away from the boat 100 as depicted in FIG. 1, e.g., to prevent the drive pod 102 from tearing away a portion of the hull 104. To ensure that the separation process has the desired effect of preventing further damage to the boat 100 rather than inflicting more damage, it is important that the shaft assembly 108 breaks at a predetermined location 116 with a known shape so that seals in the engine 106 or more specifically in an engine room where the engine 106 is located are protected. Beyond preserving the integrity of the hull 104, breaking the shaft 122 at the predetermined location 116 may also protect seals in the drive pod 102 so that the drive pod 102 does not leak oil into the environment and so that seawater (or freshwater depending on the environment) does not enter the drive pod 102 and cause further damage beyond that of the original impact. In the illustrated embodiment, the shaft assembly 108 is shown separated at a base of the spline portion 110.

Figure 2:
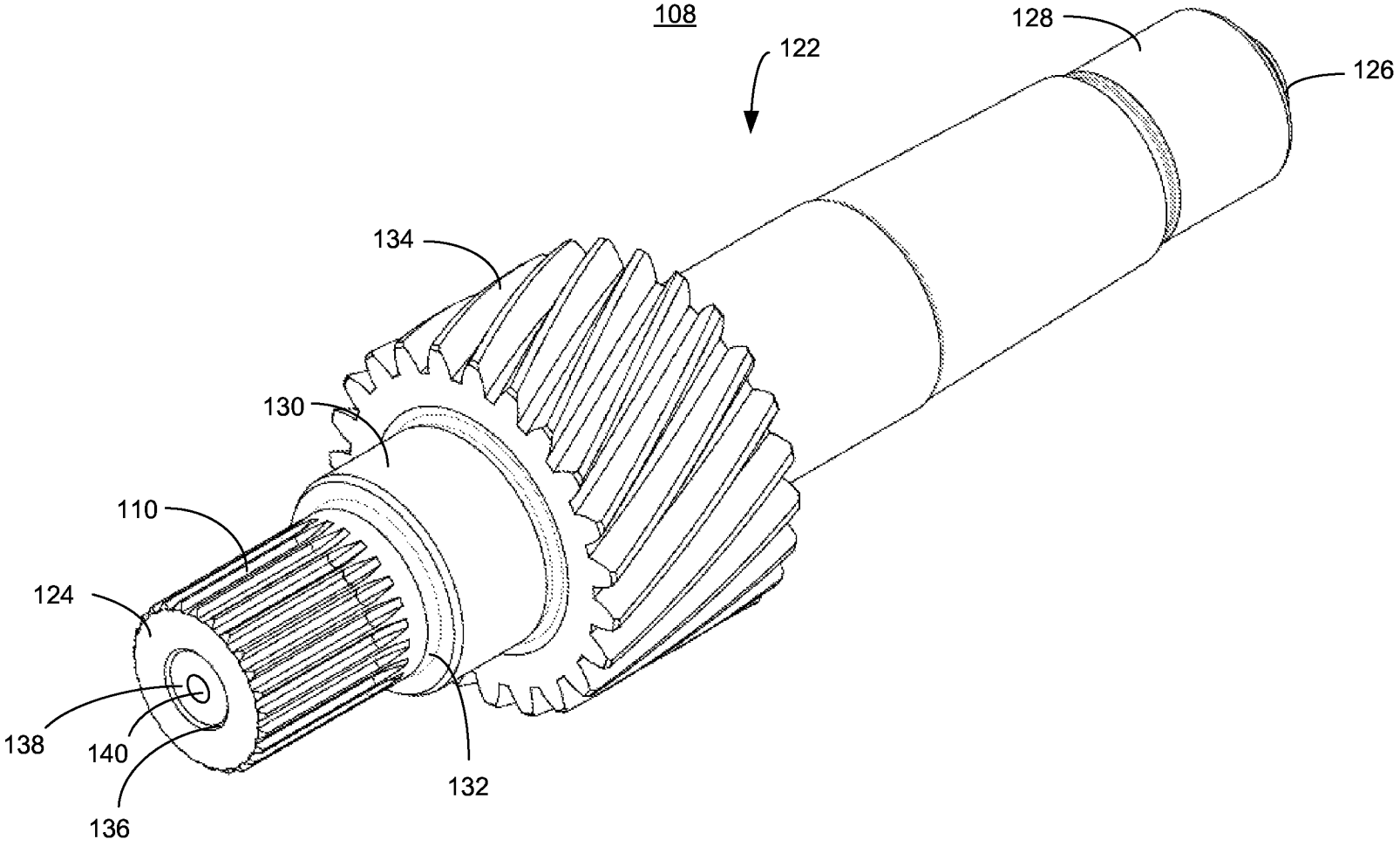
FIG. 2 is a perspective view of a shaft assembly according to an embodiment of the disclosure.

FIG. 2 illustrates an embodiment of the shaft assembly 108 as manufactured. The shaft assembly 108 may include a shaft 122 and a pin 138. The shaft 122 may have a first end 124 and a second end 126. A spline portion 110 may be formed adjacent to the first end 124. The spline portion 110 is configured for attaching to a drive shaft 112 of an engine 106 in a known manner. A shank portion 128 may be formed adjacent to the second end 126, although other arrangements of elements of the drive shaft 112 may be configured. When assembled in the drive train, the shank portion 128 may be installed into a bearing. Alternatively, the shank portion 128 may include a bearing, such as a roller bearing (not depicted).

A connecting portion 130 may be formed adjacent to the spline portion 110. After assembly into the drive pod 102, the connecting portion 130 may be disposed in another bearing or seal that ideally keeps oil in and seawater out of a gearbox 114 of the drive pod 102.

In an embodiment, the shaft 122 may have a groove 132 disposed radially about an outer circumference of the shaft 122 between the spline portion 110 and the connecting portion 130. The function of the groove 132 is discussed in more detail below.

A gear portion 134 may be disposed between the connecting portion 130 and the shank portion 128. In the illustration of FIG. 2 the gear portion 134 is shown adjacent to the connecting portion 130, however the location and type of gear for a particular embodiment is a function of the gear box 114, the location and type of bearings and seals, or other design considerations.

Figure 4:
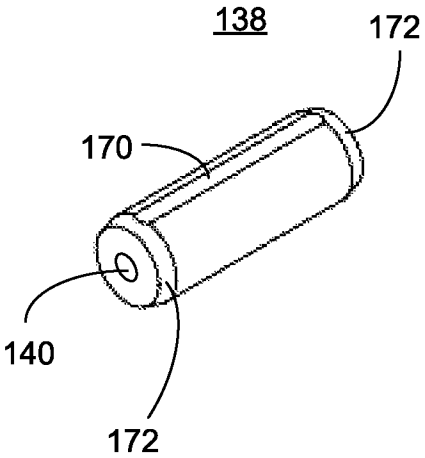
FIG. 4 is a perspective view of a pin.
Figure 3:
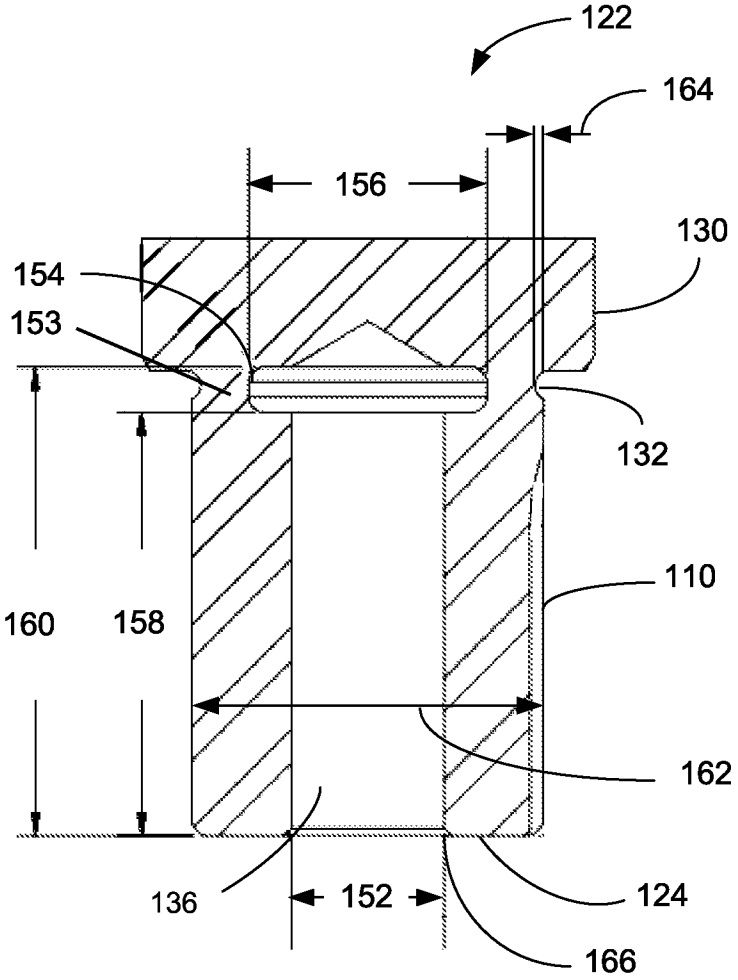
FIG. 3 is a cutaway view of a portion of the shaft.

The first end 124 of the shaft 122 may include blind hole 136 that may extend axially through the spline portion 110. The pin 138 may be disposed into the blind hole 136. To facilitate assembly, a staking hole 140 may be formed in one or both ends of the pin 138. In other embodiments, the staking hole 140 may not be present and an assembly technique other than staking may be used to insert the pin 138 into the blind hole 136. The pin 138 strengthens the shaft 122 at the spline portion 110. FIGS. 3 and 4 show additional details about the blind hole 136 and the pin 138.

FIG. 3 illustrates a cutaway view of a segment of the shaft 122 including the first end 124 the spline portion 110 and part of the connecting portion 130. The blind hole 136 is shown with a diameter 152 and a first depth 160, not including an allowance, for example, for a drill tip. In one embodiment, a chamfer 166 may be cut at an opening of the blind hole 136 at the first end 124 to facilitate installation of the pin 138 into the blind hole 136. A diameter 152 of the blind hole 136 may be in a range of 35% to 50% of an outside diameter 162 of the spline portion 110. In another embodiment, the diameter 152 of the blind hole 136 may be in a range of 40% to 45% of an outside diameter 162 of the spline portion 110. In an embodiment, the outside diameter 162 of the spline portion 110 may be in a range of 40 millimeters (mm) to 50 mm.

Using a special cutter, known in the industry, an undercut 154 may be formed at a lower extent of the blind hole 136, that is at a first depth 160. The undercut 154 has a diameter 156 that is greater than the diameter 152 of the blind hole 136 and extends toward the first end 124 to a second depth 158. That is, the width of the undercut 154 is the second depth 158 subtracted from the first depth 160. In an embodiment, the first depth 160 may be in a range of 60 to 65 mm and the second depth may be in a range of 52 mm to 60 mm. In one embodiment the width of the undercut is in a range of 5 mm to 7 mm. In other embodiments, the width of the undercut may range up to 13 mm or more based on the diameter of the shaft being used, the type of material, and the expected torque and breakaway forces.

In an embodiment, the diameter 156 of the undercut 154 is in a range of 55%-75% of the outside diameter 162 of the spline portion 110. In another embodiment, the diameter 156 of the undercut 154 is in a range of 65% to 70% of the outside diameter 162 of the spline portion 110. In one embodiment, the diameter 156 of the undercut 154 is in a range of 29 mm to 33 mm. All ranges of width and diameter of the undercut 154 are for specific shaft diameters and appropriate adjustments may be made for different shaft diameters. A groove 132 may be formed radially displaced from the undercut 154 on an outer surface of the shaft 122. In an embodiment, the width of the groove 132 may be different from the width of the undercut 154. Similarly, the deepest point of the groove 132 may not be aligned with the widest point of the undercut 154, but in most embodiments the groove 132 and undercut 154 may overlap axially.

A depth 164 of the groove 132 may be in a range of 0% to 7% of the outside diameter 162 of the spline portion 110. In another embodiment, the depth 164 of the groove 132 may be in a range of 2% to 3% of the outside diameter 162 of the spline portion 110. In one embodiment, the depth 164 of the groove 132 may be in a range of 1.0 mm to 1.4 mm. The groove 132 may not be used in some embodiments, that is, in some applications the undercut 154 may be the only element used to reduce the area of the cross-section at the lower extent of the blind hole 136. In other embodiments, the groove 132 may be less than 2% or more than 7% of the diameter 162 of the spline portion 110 based on the diameter of the shaft being used, the material type, and the expected torque and breakaway forces. The groove 132 and the undercut 154, together or separately form a thinned portion 153 of the shaft 122.

FIG. 4 is a perspective view of the pin 138. The pin 138 may be made from round stock and may have a groove or channel 170 cut or otherwise disposed lengthwise along the pin 138. The channel 170 allows air or other fluid in the blind hole 136 to be displaced from a cavity 174 (FIG. 5) as the pin 138 is inserted into the blind hole 136. For example, in an embodiment a fastener such as glue or epoxy may be disposed in the blind hole 136 or on the pin 138 prior to insertion. If the channel 170 were not provided, the buildup in pressure behind the pin 138 could cause the pin 138 to back out of the blind hole 136 prior to the glue or epoxy setting sufficiently to hold the pin 138. In the illustrated embodiment the channel 170 is cut on an outside circumference of the pin 138. In another embodiment, the staking hole 140 may be drilled or otherwise formed axially along the full length of the pin 138 so that venting during installation could occur through the staking hole 140. A bevel or chamfer 172 may be cut or otherwise disposed on the pin 138 to aid in assembly. Even when not drilled through the length of the pin 138 the staking hole 140 may be formed on both ends to simplify manufacturing operations by allowing the pin 138 to be inserted in either direction.

Figure 5:
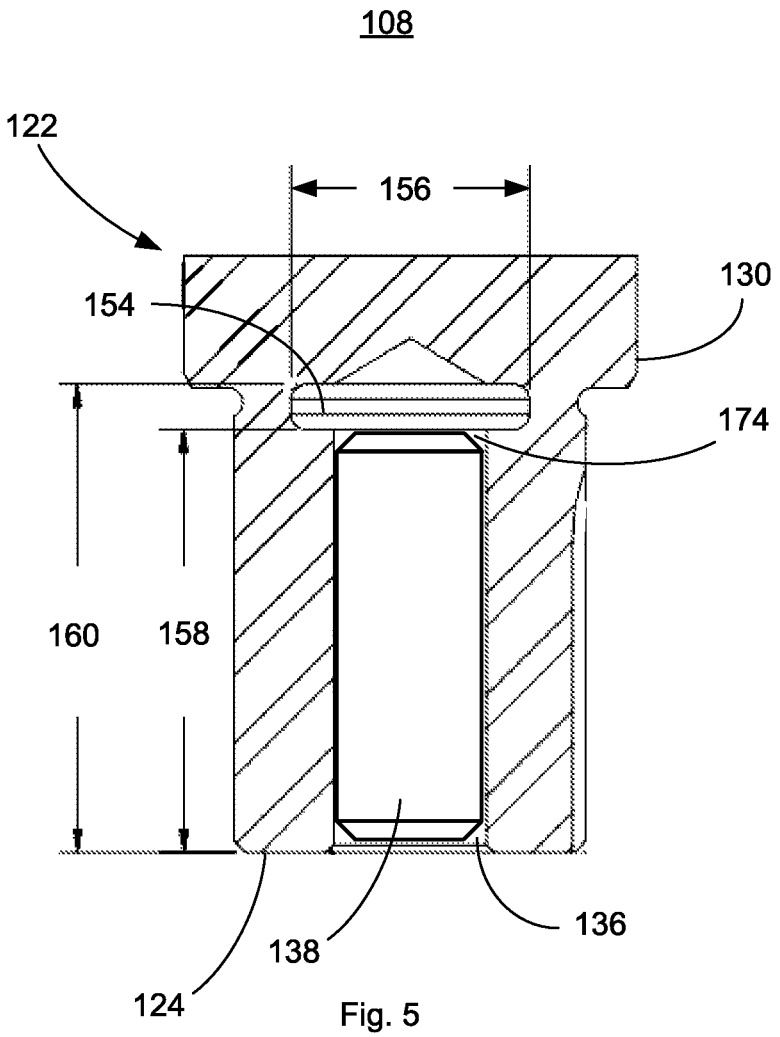
FIG. 5 is a cutaway view of a portion of the shaft assembly.

FIG. 5 is a cutaway view of a portion of the shaft assembly 108 showing one segment of the shaft 122 with the pin 138 installed in the blind hole 136. The pin 138 may extend from the first end 124 to the second depth 158. In various embodiments the pin 138 may not be flush with the first end 124 but may protrude beyond the first end 124 or recess into the blind hole 136. At the other end, the pin 138 may extend to the second depth 158 but an exact placement is not necessary and the pin 138 may extend into the undercut 154 or may not fully extend to the second depth 158.

Figure 6:
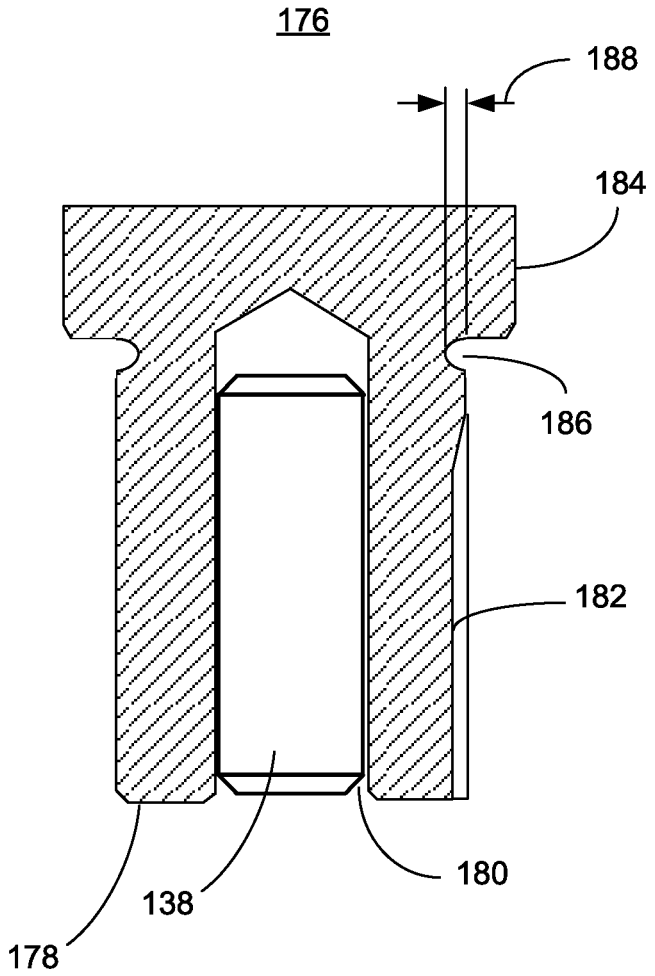
FIG. 6 is a cutaway view of a portion of another shaft assembly.

FIG. 6 illustrates a portion of a breakaway shaft assembly 176 according to another embodiment. In this embodiment, the shaft 176 has a first end 178, a spline portion 182 and a connecting portion 184. The shaft 176 may also include a blind hole 180, but unlike the embodiment illustrated in FIGS. 3 and 5, the blind hole 180 has no undercut. In this embodiment, a groove 186 may be cut deeper than the groove of the earlier described embodiments. For example, the groove 186 may have a depth 188 that is 10%-20% of a diameter of the spline portion, although other depths may be implemented according to the material used, a torque load on the shaft assembly 176 during normal operation, and a design requirement for a shear force that causes the drive pod 102 to separate from the hull 104. A deepest point of the groove 186 may be aligned with the bottom of the blind hole 180, but that is not a requirement. In other embodiments, the groove 186 may have some axial overlap with the bottom of the blind hole 180 or may only be axially aligned near the bottom of the blind hole 180.

Also as above, a pin 138 may be disposed in the blind hole 180 to stiffen the spline portion 182 and direct shear force energy to a thinned cross-sectional area at a lower extent of the blind hole, either blind hole 136 or blind hole 180. That is, an two-dimensional area of a cross-section of the spline portion 110 or 182 is larger than a corresponding two-dimensional area of a cross-section at the lower extent of the blind hole 136 or 180.

INDUSTRIAL APPLICABILITY

Figure 7:
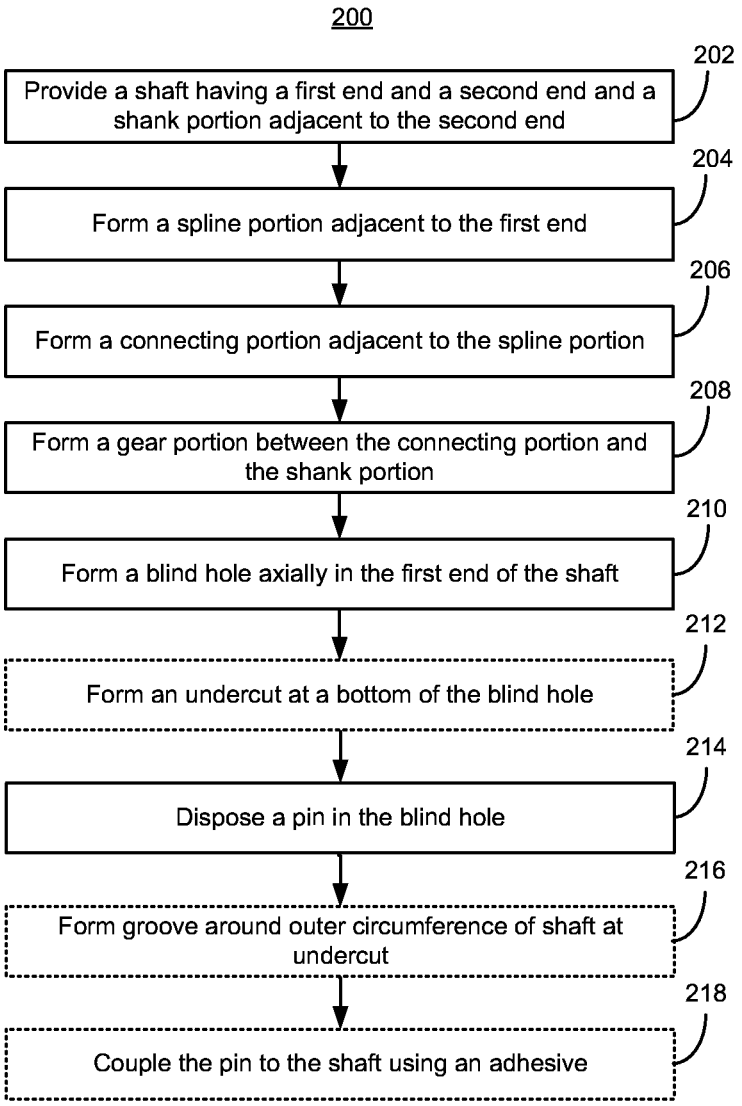
FIG. 7 is a flowchart of a method of assembling the shaft assembly.

FIG. 7 illustrates a method 200 of making a shaft assembly 108 for use in a drive pod 102 of a marine craft propulsion system. Many of the following steps may be performed in different order or in parallel.

At block 202, a shaft 122 is provided. The shaft 122 has a first end 124 and second end 126 opposite the first end 124, with a shank portion 128 adjacent to the second end 126. At block 204, a spline portion 110 may be formed adjacent to the first end 124 of the shaft 122. At block 206, a connecting portion 130 may be formed adjacent to the spline portion 110. In an embodiment, the connecting portion 130 may engage a seal and/or bearing of the drive pod 102 after installation.

At a block 208, a gear portion 134 may be formed between the connecting portion 130 and the shank portion 128. The gear portion 134 may be a pinion gear or other gear suitable for transmitting power generated in the engine 106 to a propeller (not depicted) or other drive unit in a drive pod 102.

Optionally, at a block 210, a blind hole 136 may be formed axially in the first end 124 of the shaft 122. The blind hole 136 may extend from the first end 124 through the spline portion 110 at least to a depth at or beyond where the designed point of failure is to be located. At block 212, an undercut 154 may be formed at a bottom of the blind hole 136, defining the desired point of failure. The bottom, or lower extent, of the blind hole 136 is understood to be the point farthest from the first end 124 that maintains the full diameter of the blind hole 136, exclusive of any additional depth of lesser diameter, such as that formed by a drill tip. The dimensions of the blind hole 136 and the undercut 154 are discussed in more detail above. However, in other embodiments, the blind hole 136 may extend through the gear portion 134 with a correspondingly longer pin 138.

At a block 214, a pin 138 may be disposed in the blind hole 136 between the first end 124 and the undercut 154 forming a shaft assembly 108 from the shaft 122 and the pin 138. The pin 138 may be inserted into the shaft 122 using a staking machine, press, etc. The pin 138 reinforces the blind hole 136 underneath the spline portion 110 of the shaft 122 so that when a shearing or other breaking force is applied to the shaft assembly 108, the shaft assembly 108 reliably separates at the undercut 154. Disposing the pin 138 in the blind hole 136 may also include venting a cavity 174 formed by the pin 138 during insertion into the blind hole 136. To accommodate venting the cavity 174, a channel 170 may be formed axially on an outer surface of the pin 138. Alternatively, a vent hole, e.g., an extension of staking hole 140, may be formed longitudinally through the pin 138.

At block 216, optionally in addition to, or in the absence of an undercut 154, a groove 132 may be formed around an outer circumference of the shaft 122, the groove 132 may be axially aligned with the undercut 154.

Optionally at block 218, the pin 138 may be coupled to the shaft 122 at the blind hole 136 using an adhesive, known in the art. In another embodiment, the pin 138 may be coupled to the shaft 122 at the blind hole 136 using a swage or other mechanical deformation.

Strengthening the shaft 122 using the pin 138 in the spline portion 110 reinforces the blind hole 136 created to allow forming the undercut 154 so that when a shear force is applied the shaft assembly 108 separates at the undercut 154 and not in the spline portion 110 or farther down the shaft 122. Further, the undercut 154, with or without the groove 132, allows for a relatively clean radial break at the undercut 154, avoiding a longitudinal break lengthwise along a prior art shaft that could endanger seals and other engine or transmission components.

The use of the shaft assembly 108 protects both the drive pod 102 and the hull 104 of the boat 100 during an underwater impact. Because the shaft assembly 108 separates at a precise location other areas of the shaft 122, such as the connecting portion 130 are preserved so that their associated bearings or seals can avoid damage. This prevents oil from the drive pod 102 from escaping into the environment and seawater from entering the drive pod 102 through the bearings or seals. The spline portion 110 is also protected from damage that may be transmitted further into the engine 106 and its drive shaft 112.

We claim:

1. A drive pod for use in a marine craft propulsion system, the drive pod comprising:

a housing configured for through-hull coupling to an engine;

a gearbox; and a shaft coupled between the gearbox and the engine, the shaft including:

a spline portion disposed at a first end of the shaft;

a shank portion at a second end of the shaft distal to the first end;

a connecting portion adjacent to the spline portion;

a blind hole disposed axially in the first end that extends to a first depth through the spline portion;

a thinned portion axially aligned with a lower extent of the blind hole, the thinned portion having an axial cross-sectional area that is smaller than a cross-sectional area of the spline portion;

a gear portion between the spline portion and the shank portion; and a pin disposed in the blind hole to a second depth from the first end, the second depth less than the first depth.

2. The drive pod of claim 1, wherein the thinned portion has an undercut at a bottom of the blind hole.

3. The drive pod of claim 1, wherein a diameter of the undercut is a range of 55% to 75% of an outside diameter of the spline portion.

4. The drive pod of claim 1, further comprising an adhesive disposed in the blind hole that adheres the pin to the blind hole.

5. The drive pod of claim 1, wherein the pin has a vent axially along its length that releases backpressure when the pin is inserted into the blind hole.

6. The drive pod of claim 1, wherein the pin has a staking hole disposed axially in the pin for use in installing the pin into the blind hole.

7. The drive pod of claim 1, wherein the thinned portion has a groove disposed circumferentially between the spline portion and the connecting portion and radially outward from a bottom of the blind hole.

8. A method of making a shaft assembly for use in a drive pod of a marine craft propulsion system, the method comprising:

providing a shaft having a first end and second end opposite the first end, with a shank portion adjacent to the second end;

forming a spline portion adjacent to the first end of the shaft;

forming a connecting portion adjacent to the spline portion;

forming a gear portion between the spline portion and the shank portion;

forming a blind hole axially in the first end of the shaft;

forming a thinned portion axially aligned with a bottom of the blind hole, the thinned portion having an axially symmetric cross-sectional area that is smaller than a cross-sectional area of the spline portion, wherein the thinned portion has an undercut formed at a bottom of the blind hole; and disposing a pin in the blind hole between the first end and the thinned portion.

9. A shaft assembly for use in a drive pod of a marine craft, the shaft assembly comprising:

a shaft including:

a spline portion disposed at a first end of the shaft;

a connecting portion adjacent to the spline portion;

a blind hole disposed axially in the first end, the blind hole extending through the spline portion, the blind hole having an undercut at a lower extent of blind hole;

a gear portion and a shank portion arranged between the connecting portion and a second end of the shaft distal to the first end, the shank portion configured for mating with a bearing in the drive pod; and a pin disposed in the blind hole of the shaft.

10. The shaft assembly of claim 9, further comprising an adhesive disposed in the blind hole that adheres the pin to the shaft at the blind hole.

11. The shaft assembly of claim 9, wherein a diameter of the blind hole is 35% to 50% of an outside diameter of the spline portion.

12. The shaft assembly of claim 9, wherein a diameter of the undercut is a range of 55% to 75% of an outside diameter of the spline portion.

13. The shaft assembly of claim 9, wherein the shaft has a groove formed about an outer circumference of the shaft located radially outward from the undercut.

14. The shaft assembly of claim 9, wherein the pin has a vent axially along its length that releases backpressure when the pin is inserted into the blind hole.

* * * * *